US006837796B2

(12) United States Patent
Bernhardt

(10) Patent No.: US 6,837,796 B2
(45) Date of Patent: Jan. 4, 2005

(54) BOWLING BALL FINGER GRIP

(76) Inventor: David A. Bernhardt, 4921 Deer Clerk Cir. South, Washington Township, MI (US) 48094

( * ) Notice: Subject to any disclaimer, the term of this patent is extended or adjusted under 35 U.S.C. 154(b) by 189 days.

(21) Appl. No.: 09/017,959

(22) Filed: Feb. 3, 1998

(65) Prior Publication Data

US 2003/0045367 A1 Mar. 6, 2003

(51) Int. Cl.[7] ..... A63F 5/04
(52) U.S. Cl. ..... 473/61; 2/21
(58) Field of Search ..... 473/61, 127, 128; 2/21, 161.3, 163; D4/103; D8/3; 294/25

(56) References Cited

U.S. PATENT DOCUMENTS

| | | | | |
|---|---|---|---|---|
| 189,674 | A | | 4/1877 | Woods |
| 447,011 | A | | 2/1891 | Harman |
| 580,207 | A | | 4/1897 | Boemermann et al. |
| 626,584 | A | | 6/1899 | Wilmerling |
| 673,688 | A | | 5/1901 | Pickett |
| 950,838 | A | | 3/1910 | Cavanagh |
| 1,021,490 | A | | 3/1912 | Scully |
| D97,360 | S | * | 10/1935 | Stevens ..... D4/103 |
| 2,273,199 | A | | 2/1942 | Hilton et al. |
| 2,274,522 | A | | 2/1942 | Bomze |
| 2,347,881 | A | | 5/1944 | Cahen |
| 2,460,385 | A | | 2/1949 | Hausman |
| 2,485,471 | A | | 10/1949 | Bates |
| 2,646,985 | A | | 7/1953 | Nagy et al. |
| 2,708,578 | A | | 5/1955 | Mitchell |
| 2,843,382 | A | | 7/1958 | Ross |
| 2,935,354 | A | * | 5/1960 | Chapman ..... 2/21 |
| 3,078,097 | A | | 2/1963 | Mitchell |
| 3,091,455 | A | * | 5/1963 | De Mire ..... 473/61 |
| 3,728,736 | A | * | 4/1973 | Dugh ..... 2/21 |
| 3,774,909 | A | | 11/1973 | Linden |
| 3,784,198 | A | | 1/1974 | Bach |
| 3,804,412 | A | | 4/1974 | Chetirko |
| 4,247,102 | A | | 1/1981 | Seyler |
| 4,289,312 | A | | 9/1981 | Heimbigner |
| 4,358,112 | A | | 11/1982 | Straborny |
| 4,381,863 | A | | 5/1983 | Norman |
| 4,416,452 | A | | 11/1983 | Heimbigner |
| 4,432,546 | A | | 2/1984 | Allen, Jr. |
| 4,530,502 | A | | 7/1985 | Yamane |
| 4,560,162 | A | | 12/1985 | Miller |
| 4,561,654 | A | | 12/1985 | Haza |
| 4,569,520 | A | | 2/1986 | Yamane |
| 4,585,230 | A | | 4/1986 | Martin |
| 4,623,149 | A | | 11/1986 | Herman |
| 4,632,396 | A | | 12/1986 | Taylor |
| 4,699,380 | A | | 10/1987 | Mace |
| 4,773,645 | A | | 9/1988 | Todd et al. |
| 4,778,178 | A | | 10/1988 | Haza |
| 5,002,276 | A | | 3/1991 | Bernhardt |
| 5,007,640 | A | | 4/1991 | Bernhardt |
| 5,123,644 | A | | 6/1992 | Bernhardt |
| 5,176,378 | A | | 1/1993 | Bernhardt |
| 5,308,061 | A | | 5/1994 | Bernhardt |
| 5,688,181 | A | * | 11/1997 | Albert ..... 473/61 |

* cited by examiner

*Primary Examiner*—William M. Pierce
(74) *Attorney, Agent, or Firm*—Harness, Dickey & Pierce, P.L.C.

(57) ABSTRACT

A finger grip (10) for a bowling ball (14) has a mechanism (20) to retain the grip to a bowler's finger (12). A pad (24) is included to contact the bowling ball (14). The bowling ball (14) is associated with the retention mechanism. Also the pad (24) has an arcuate surface.

12 Claims, 2 Drawing Sheets

BOWLING BALL FINGER GRIP

BACKGROUND AND SUMMARY OF THE INVENTION

The present invention relates to bowling, and more particularly to a gripping device positioned on the bowler's index finger to enable the bowler to impart spin upon the bowling ball.

In bowling, while the ball is rolling down the lane, it is desirous to produce rotation about the horizontal axis of the ball. This rotation creates a hook in the ball as it is rolled down the lane. The hook action on the ball enables the ball to move laterally with respect to the pins so that the ball contacts more pins creating pin action to increase the number of pins knocked down.

In order to create hook on the bowling ball, the bowler contacts his index finger against the ball. In doing so, the bowler creates friction on his finger, which, in turn causes blisters or callouses to form on the bowler's index finger. Since both blisters and callouses are undesirable, bowlers search for aids to eliminate these ailments. Bowlers have used tape, bandages and the like to prohibit blisters or callouses. However, these surfaces become glazed and do not enable the bowler to exert the proper friction, in turn, rotation onto the ball to create the desired hook.

Accordingly, bowlers desire an aid which protects against blisters and callouses while providing a superior surface for gripping the ball.

The present invention provides the art with such a device. The present invention provides the art with a grip which protects against blisters and callouses while providing a superior gripping action on the ball. The gripping surface of the present invention enables the bowler to achieve additional revolutions on the ball while it is rolling down the lane.

From the following detailed description, taken in conjunction with the drawings and appended claims, other objects and advantages of the present invention will become apparent to those skilled in the art.

DETAILED DESCRIPTION OF THE PREFERRED EMBODIMENT

Figure 1:
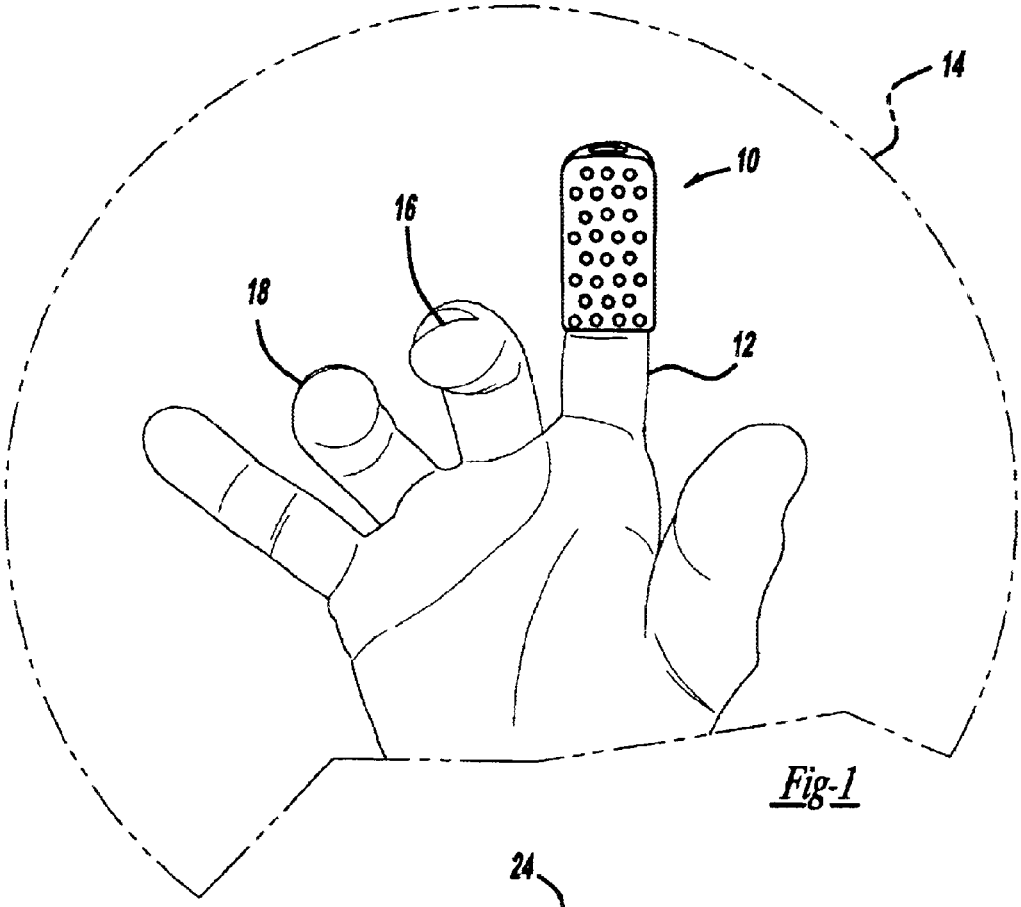
FIG. 1 is a perspective view of the finger grip on a bowler in use viewed from within the bowling ball.
Figure 2:
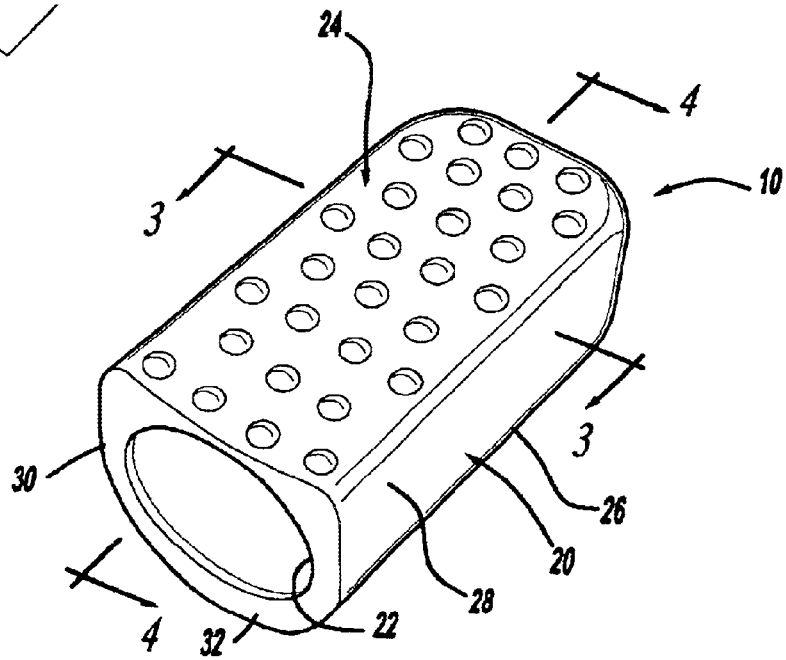
FIG. 2 is a perspective view of the finger insert according to FIG. 1.

Turning to the figures, particularly FIG. 1, the finger insert in accordance with the invention is shown and identified with the reference numeral 10. The finger grip 10 is illustrated on a bowler's index finger 12 in contact with the ball 14. The bowler's middle finger and ring finger 16 and 18 are illustrated within the holes of the ball.

The finger grip 10 has a tubular shaped body 20 defining a bore 22. The body is made from a polymeric material being substantially resilient. The bore 22 when viewed along its axis (as in FIG. 3) has an elliptical configuration. The body 20 includes a pad portion 24 and a retention portion 26. The retention portion 26 has an overall U-shaped configuration having legs 28 and 30 connected by web 32. The legs and web surround the sides and top of the finger. Also, the web 32 is tapered at the closed end of the bore 22 to conform to the bowler's finger. Thus, the taper 34 is in close proximity to or contacts the fingernail of the bowler providing a close fit within the bore 22.

Figure 3:
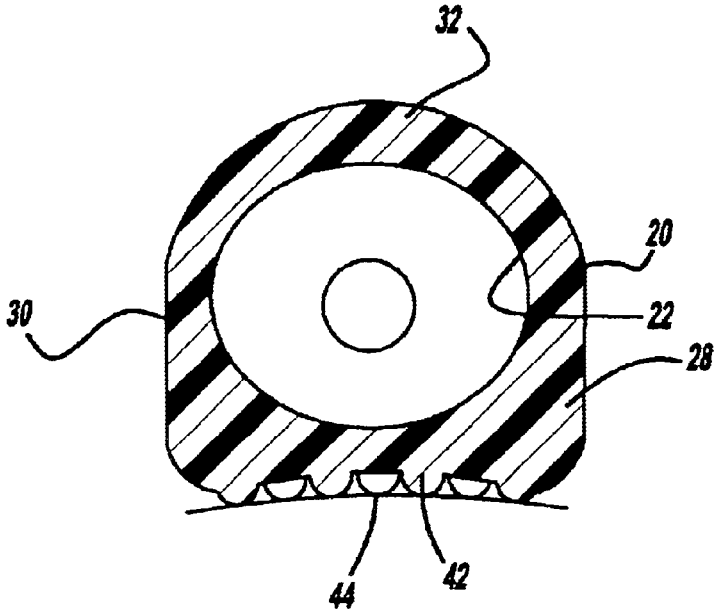
FIG. 3 is a cross-sectional view of FIG. 2 along line 3—3 thereof.
Figure 4:
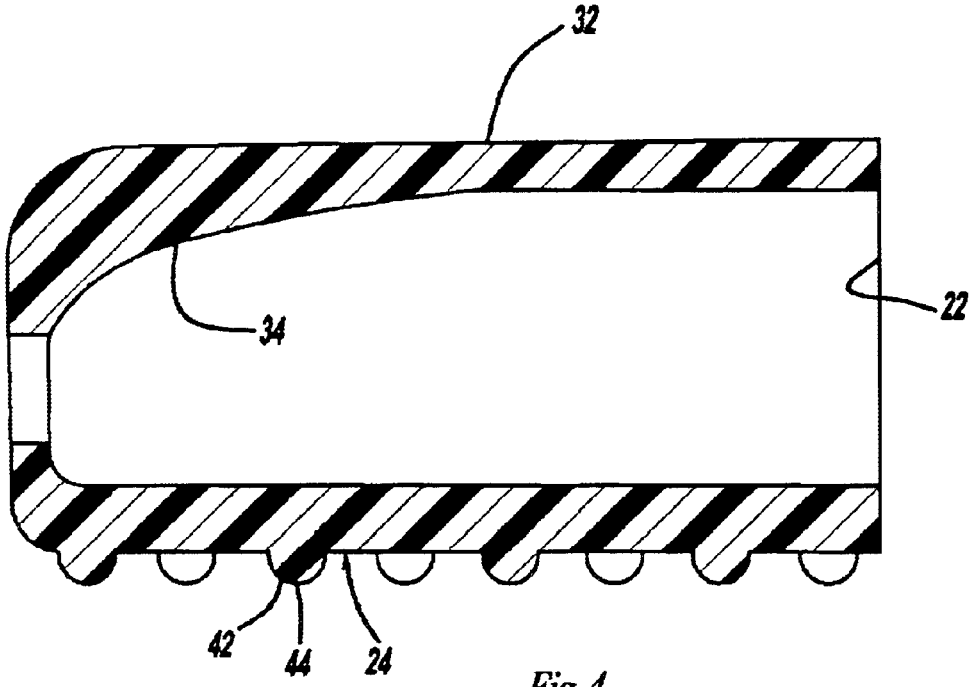
FIG. 4 is a cross-sectional view of FIG. 2 along line 2—2 thereof.

The pad 24 is connected with the legs 28, 30 of the retention portion 26 to provide the tubular body 20 with an overall D-shaped configuration when viewed along its axis as seen in FIG. 3. The pad portion 24 has a curved surface 40 which includes one or more projecting members 42. The curved surface 40 has a curvature which conforms to the outer surface of a bowling ball. Thus, the radius of the curvature is substantially equal to the radius of the bowling ball 14. Likewise, the curvature of the surface 40 is substantially the same as the curvature of the bowling ball. The surface is thus concave.

The projecting members 42 are positioned in a desired pattern along the rectangular face of the pad. Ordinarily, the pattern is such that the projections are positioned in rows having adjacent row with one less or one more projections 42 when moving longitudinally along the longitudinal axis of the tube 20. Also, the rows of projections 42 are aligned laterally with one another such that a straight line would be formed through their centers.

The projections 42 are on the curved surface 44 such that a line drawn through the tips of the projections defines a curve which has a curvature substantially the same as that of the bowling ball. The projections 42 have a hemispherical end for contacting the bowling ball. As the end 44 contacts the ball, depending upon the pressure exerted by the finger, the hemisphere will flatten, forming a circular face onto the bowling ball as illustrated in FIG. 1. Thus, the projections will grip the bowling ball enabling the bowler to better initiate rotation as the bowling ball is released. The projection members 42 could have a number of different configurations such as truncated right cylinders, tetrahedrons, or the like.

While the above detailed description describes the preferred embodiment of the present invention, the invention is susceptible to modification, variation and alteration without deviating from the scope and fair meaning of the subjoined claims.

What is claimed is:

1. A bowling accessory, comprising:

a mechanism for retaining the accessory to a bowler's finger;

a pad having one or more projections for contacting a bowling ball, said pad associated with said retaining mechanism, and said pad having an arcuate surface, said projections having desired configuration such that tips of said projections define a curve which has a curvature substantially like a curvature of the bowling ball, and when force is exerted by the bowler on the ball the projections flatten providing a larger surface to grip the bail enabling the bowler to better initiate rotation as the bowling bail is released.

2. The bowling accessory according to claim 1, wherein said plurality of projections are in a desired pattern.

3. The bowling accessory according to claim 1, wherein said arcuate surface has a radius which is complementary to a radius of a bowling ball.

4. The bowling accessory according to claim 1, wherein said arcuate surface is concave.

5. A bowling finger grip, comprising:

a tubular member having a bore for receiving the finger of a bowler;

a gripping surface on said tubular member, a plurality of gripping members on said gripping surface for contacting a bowling ball, said gripping surface being curved, said gripping members comprising projections having desired configuration such that tips of said projections define a curve which has a curvature substantially like a curvature of the bowling ball, and when force is exerted by the bowler on the ball the gripping members flatten providing a larger surface to grip the ball enabling the bowler to better initiate rotation as the bowling ball is released.

6. The bowling finger grip according to claim 5, wherein said gripping members have a convex face for contacting the bowling ball.

7. The bowling finger grip according to claim 5, wherein said bore is tapered at one end for enhancing fit with a bowler's finger tip.

8. The bowling finger grip according to claim 5, wherein said curve of said gripping surface has a curvature substantially the same as the bowling ball curvature.

9. The bowling finger grip according to claim 5, wherein said gripping surface includes a plurality of projecting members positioned in a desired pattern on said gripping surface.

10. The bowling finger grip according to claim 9, wherein said projecting members are aligned with one another.

11. The bowling finger grip according to claim 5, wherein said tubular member has a D-shaped section viewed along a longitudinal axis.

12. The bowling finger grip according to claim 11, wherein said bore is elliptical viewed along a longitudinal axis.

* * * * *

UNITED STATES PATENT AND TRADEMARK OFFICE

CERTIFICATE OF CORRECTION

PATENT NO. : 6,837,796 B2
DATED : January 4, 2005
INVENTOR(S) : David A. Bernhardt It is certified that error appears in the above-identified patent and that said Letters Patent is hereby corrected as shown below:

Title page,
Item [76], Inventors, "Deer Clerk" should be -- Deer Creek --
Item [56], References Cited, OTHER PUBLICATIONS, "Dugh" should be -- Pugh --

Column 3,
Lines 1 and 2, "bail" should be -- ball --

Signed and Sealed this

Twenty-sixth Day of April, 2005

JON W. DUDAS
*Director of the United States Patent and Trademark Office*